US005953844A

United States Patent [19]

Harling et al.

[11] Patent Number: 5,953,844

[45] Date of Patent: Sep. 21, 1999

[54] AUTOMATIC FIREARM USER IDENTIFICATION AND SAFETY MODULE

[75] Inventors: Gord Harling, Bromont; Abdellah Azelmad, Montreal; Rodney Miller, Westmount, all of Canada

[73] Assignee: Quantum Leap Research Inc., Quebec, Canada

[21] Appl. No.: 09/201,791

[22] Filed: Dec. 1, 1998

[51] Int. Cl.[6] ..... F41A 17/46

[52] U.S. Cl. ..... 42/70.06; 42/70.08; 42/70.11

[58] Field of Search ..... 42/70.05, 70.06, 42/70.08, 70.11

[56] References Cited

U.S. PATENT DOCUMENTS

| | | | |
|---|---|---|---|
| 4,021,955 | 5/1977 | Curtis | 42/70 F |
| 4,305,218 | 12/1981 | Godsey | 42/70 F |
| 4,488,370 | 12/1984 | Lemelson | 42/70 R |
| 4,509,281 | 4/1985 | Dreiling et al. | 42/1 Y |
| 4,563,827 | 1/1986 | Heltzel | 42/70 R |
| 4,573,046 | 2/1986 | Pinnow | 340/825.56 |
| 4,682,435 | 7/1987 | Heltzel | 42/70.01 |
| 4,763,431 | 8/1988 | Allan et al. | 42/70.11 |
| 4,987,693 | 1/1991 | Brooks | 42/70.11 |
| 5,022,175 | 6/1991 | Oncke et al. | 42/70.11 |
| 5,062,232 | 11/1991 | Eppler | 42/70.11 |
| 5,168,114 | 12/1992 | Enget | 42/70.01 |
| 5,283,971 | 2/1994 | Fuller et al. | 42/70.07 |
| 5,392,552 | 2/1995 | McCarthy et al. | 42/70.07 |
| 5,423,143 | 6/1995 | Martin | 42/70.01 |
| 5,433,028 | 7/1995 | Novak et al. | 42/70.06 |
| 5,448,847 | 9/1995 | Teetzel | 42/70.11 |
| 5,475,377 | 12/1995 | Lee | 340/825.34 |
| 5,487,234 | 1/1996 | Dragon | 42/70.07 |
| 5,515,634 | 5/1996 | Kong | 42/70.11 |
| 5,548,914 | 8/1996 | Anderson | 42/66 |
| 5,560,135 | 10/1996 | Ciluffo | 42/70.07 |
| 5,561,935 | 10/1996 | McCarthy et al. | 42/70.07 |
| 5,564,211 | 10/1996 | Mossberg et al. | 42/70.11 |
| 5,583,485 | 12/1996 | Van Lente et al. | 340/525 |
| 5,603,179 | 2/1997 | Adams | 42/70.08 |
| 5,649,383 | 7/1997 | Wesp et al. | 42/75.01 |
| 5,675,925 | 10/1997 | Würger | 42/70.11 |
| 5,704,152 | 1/1998 | Harrison et al. | 42/70.07 |
| 5,712,626 | 1/1998 | Andreou et al. | 340/825.31 |
| 5,713,149 | 2/1998 | Cady et al. | 42/70.06 |

FOREIGN PATENT DOCUMENTS

| | | | |
|---|---|---|---|
| 4303333 | 6/1994 | Germany | 42/70.11 |

*Primary Examiner*—Stephen M. Johnson
*Attorney, Agent, or Firm*—McDermott, Will & Emery

[57] ABSTRACT

An automatic firearm safety system where power consumption is reduced and safety is increased is disclosed. The system includes a movement detector operatively associated with a trigger of a firearm for detecting movement of the trigger. The system also has a transceiver operatively associated with the movement detector for sending a coded signal when movement of the trigger has been detected. The coded signal is received by at least one remote token which receives the coded signal and transmits a coded acknowledgement signal upon receipt of the coded signal. A solenoid is also provided for locking and unlocking the trigger, operatively associated with the transceiver for allowing operation of the trigger and thereby the firing of the firearm when the coded acknowledgement signal has been received by the transceiver. The system may include two tokens, both of which are worn by the authorized user. In this case, the transceiver further includes an anti-collision module to discriminate between the different tokens and select which one will be permitted to issue the coded acknowledgement signal. Also preferably, the transceiver includes an anti-jamming module. Since verification of the token is done every time the trigger is depressed, safety is increased. Furthermore, since bi-directional RF communication is effected only when the trigger is depressed, power consumption is reduced.

6 Claims, 4 Drawing Sheets

AUTOMATIC FIREARM USER IDENTIFICATION AND SAFETY MODULE

FIELD OF THE INVENTION

The present invention relates to an automatic firearm user identification and safety module. More particularly, the present invention relates to such a module which prevents unauthorized users from operating a firearm. The module is designed to verify the presence of an identification signal sent by a token worn by the authorized user each time that the trigger is pulled using a communication signal and an automatic locking system to disable the firearm is no identification signal is received.

DESCRIPTION OF THE PRIOR ART

One of the dangers associated with firearms is that they may be operated by a person other than the owner of the firearm. In the context of the present invention, this other person will be hereinafter referred to as <<unauthorized user>> and the owner, or person authorized to operate the firearm will be hereinafter referred to as <<authorized user>>.

A situation which all too frequently arises is that a firearm is taken from a police officer (the authorized user) by an unauthorized user and used against the police officer, resulting in injury or death. However, it should be understood that the present invention is equally applicable to any other situation where an unauthorized user takes control of a firearm.

Many patents have been proposed to attempt to solve this problem. These patents describe different safety mechanisms to prevent the discharge of a firearm by an unauthorized user.

For example, U.S. Pat. No. 5,713,149 describes a keypad interface located on the firearm, with a trigger lock system using a solenoid. In order to enable the firearm, the user must punch a code into the keypad. However, this mechanism reduces the effectiveness of the firearm in emergency situations and does not prevent the firearm from being used by an unauthorized user once the firearm is enabled.

There has also been proposed biometrics systems for authorized user recognition. These systems verify the fingerprint or the voice of the authorized user prior to enabling the firearm, which is usually disabled. Examples of these systems can be found in U.S. Pat. Nos. 5,603,179 and 5,560,135. Typically, these systems enable the firearm when the user is approved by a recognition interface which compares a measured sample with a memorized template in the firearm. The drawback of these systems is that, for example, a police officer requires that the firearm be enabled immediately, particularly when facing a suspect. Fingerprint and voice recognition systems still have a high probability of rejecting the authorized user due to an incorrect measurement, or large variations in the biometric sample (due to, for example, stress), which can have disastrous effects for the police officer. Furthermore, these systems require more response time depending on the accuracy and precision of the recognition template.

Another example of a safety system is U.S. Pat. No. 4,682,435 where the firearm is normally enabled. The system consists of a remote transmitter carried by the authorized user which uses RF communications to disable the firearm. A receiver is integrated in the firearm with a locking mechanism using a solenoid to disable the firing pin or to block the trigger bar. The user is expected to disable the firearm by triggering the RF signal, which is unsafe in an emergency situation or in the case where the authorized user is unconscious.

Yet another example of a safety system is disclosed in U.S. Pat. No. 5,168,114. The system consists of a remote RF transmitter worn by a user and a receiver incorporated in the firearm. The locking mechanism is a solenoid electrically connected to the receiver. The firearm is normally disabled and the locking mechanism will unlock the firearm only when the transmitter, held or worn by the authorized user, is located at a predetermined distance from the firearm. The firearm will not fire if the receiver is unable to properly receive the coded RF signal from the transmitter. In this system, the transmitter transmits continuously and the locking system enables and disables the locking system depending on the distance between the firearm and the transmitter. This system has an important drawback in that the transmitter consumes a great amount of power since it is continuously transmitting. Accordingly, small batteries, suitable for incorporation into a small transmitter and receiver, are not adequate to provide long operational life. Another drawback is that if the transmitter is broken, or the battery fails when in the field, the firearm is disabled.

There also does not exist, to Applicant's knowledge, means for resolving problems associated with transmitter duplication, or transmitter jamming or noise in the prior art.

SUMMARY OF THE INVENTION

It is therefore an object of the invention to provide an automatic firearm safety module where power consumption is reduced and safety is increased. In accordance with the invention, this object is achieved with a module comprising a unit integral with a firearm. The unit includes movement detection means operatively associated with a trigger of a firearm for detecting movement of the trigger. The unit also comprises transceiver means operatively associated with the movement detection means for sending a coded signal when movement of the trigger has been detected. The coded signal is received by at least one remote token which receives the coded signal and transmits a coded acknowledgement signal upon receipt of the coded signal. Means for locking and unlocking the trigger are operatively associated with the transceiver means for allowing operation of the trigger and thereby the firing of the firearm when the coded acknowledgement signal has been received by the transceiver means.

Preferably, the system includes two tokens, both of which are worn by an authorized user. In this case, the unit integral to the firearm means further uses a collision avoidance technique to discriminate between the different signals sent by the two tokens. Also preferably, the integral unit uses an anti-jamming technique.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

Figure 1:
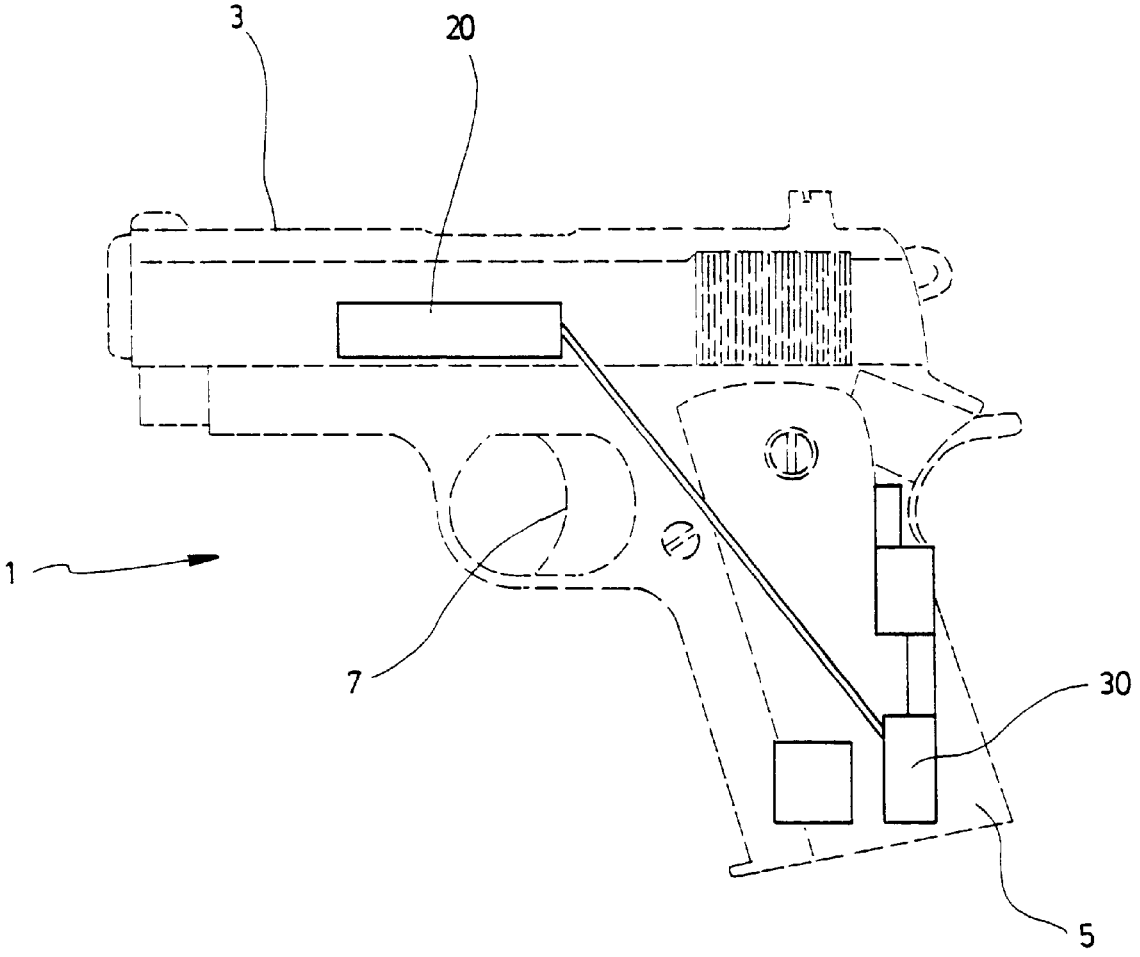
FIG. 1 is a schematic representation of a firearm incorporating the system according to a preferred embodiment of the invention.

As mentioned above, the invention is directed to an automatic safety system for a firearm 1, such as a rifle, handgun, pistol, etc. The invention may easily be adapted to any type of firearm 1, with the proper modifications. For the purposes of explaining the functioning of the present invention, it will be described as incorporated in a handgun 1, shown in FIG. 1. The handgun 1 has a barrel 3, a handle 5, a trigger 7 and a firing mechanism, all of which are well known. However, it should be understood that the following description is equally applicable for any type of firearm.

The system according to a preferred embodiment thereof includes a unit which is integrated into the firearm 1, and at least one token 40 which is remote from the firearm 1.

The unit includes movement detection means 20 operatively associated with the trigger 7 of the firearm 1, for detecting the movement of the trigger 7. Such movement detection means 20 are readily available and can take the form of a position sensor, motion sensor, pressure sensor, etc., as long as the movement detection means 20 immediately respond to motion of the trigger 7. As mentioned previously, the movement detection means 20 are integral with the firearm 1.

Figure 5:
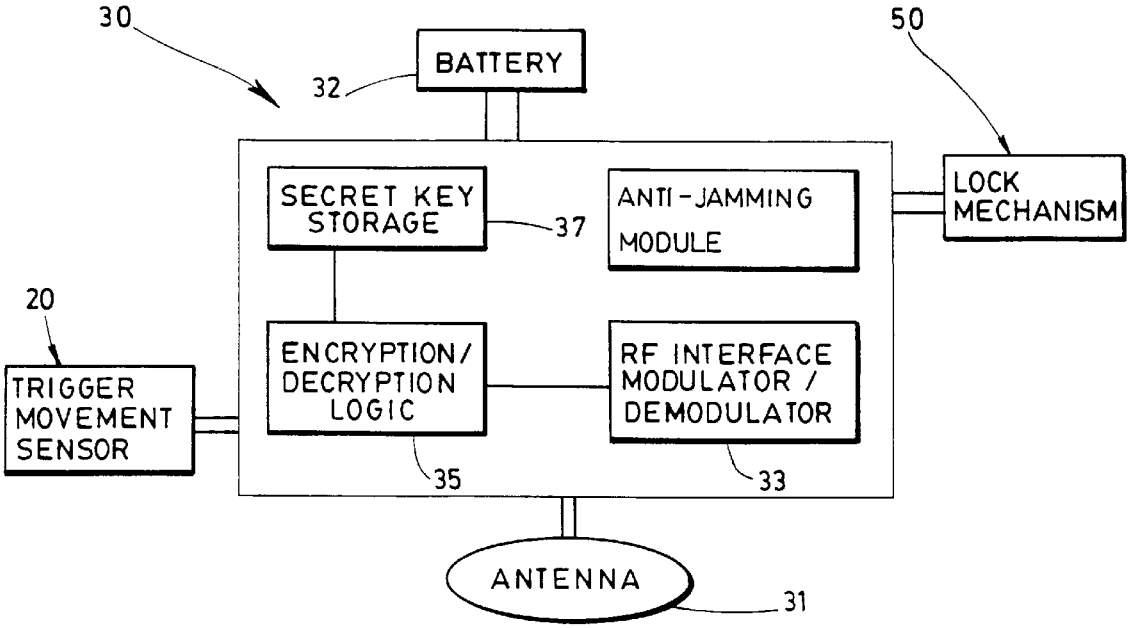
FIG. 5 is a schematic representation of the components of the unit integrated in the firearm.

The unit also includes transceiver means 30 operatively associated with the movement detection means 20 for sending a coded signal when movement of the trigger 7 has been detected. The transceiver means 30 are integral with the firearm, and are preferably located in the handle 5 of the firearm 1. The transceiver means 30 as better shown in FIG. 5, preferably include an antenna 31, a receiver 33 coupled to the antenna 31, an encoding/decoding module 35 and a transmitter 33 coupled to the antenna 31 for sending the coded signal. In a preferred embodiment shown in FIG. 5, the receiver 33 and the transmitter 33 are incorporated into a single interface. The transceiver means 30 also includes power means, such as a battery 32, for powering the transceiver means 30.

It should be noted that it is preferable for the transceiver means and the battery to be embedded into a single "pill". This should be done since replaceable batteries should not be used with the system according to the invention. If replaceable batteries were used, a user could then disable the protection afforded by the invention simply by removing or shorting the battery. Thus, if the battery is running low, the entire hand-grip could be replaced, or the unit itself only replaced and the token should be reprogrammed to match the new code.

Figure 2:
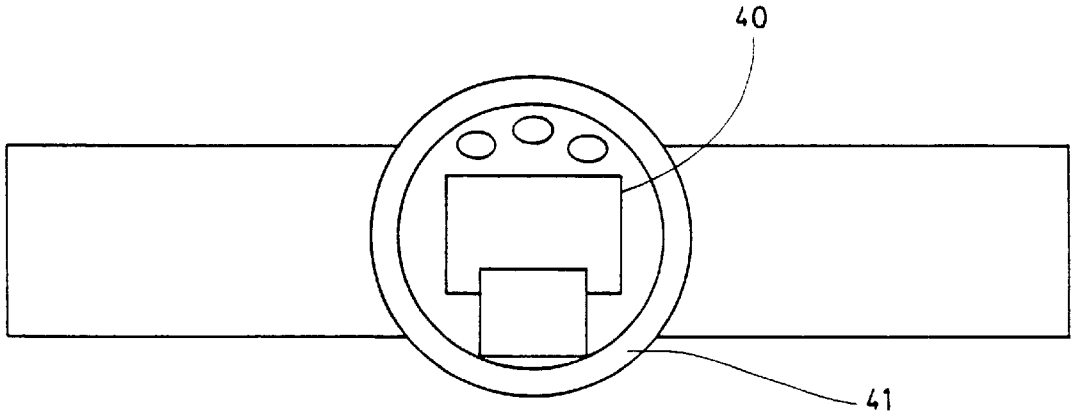
FIG. 2 is a top plan view of a token for use with the system according to the preferred embodiment of the invention incorporated into a bracelet.
Figure 3:
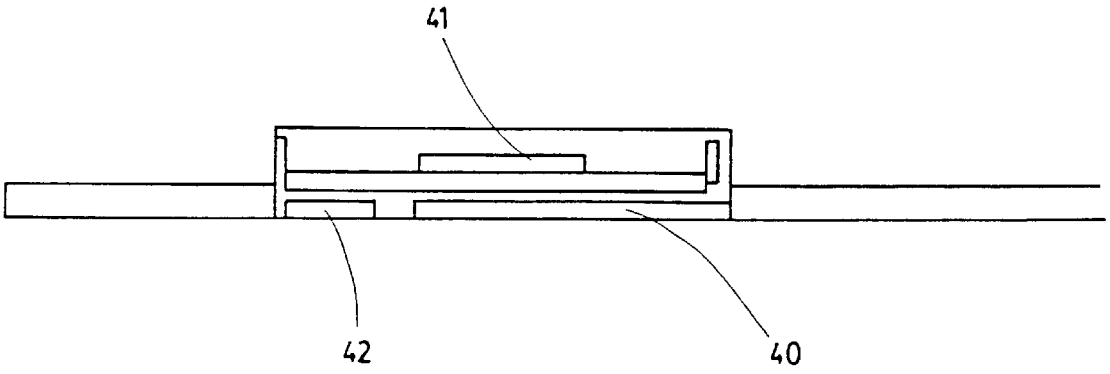
FIG. 3 is a side view of the bracelet of FIG. 2.
Figure 4:
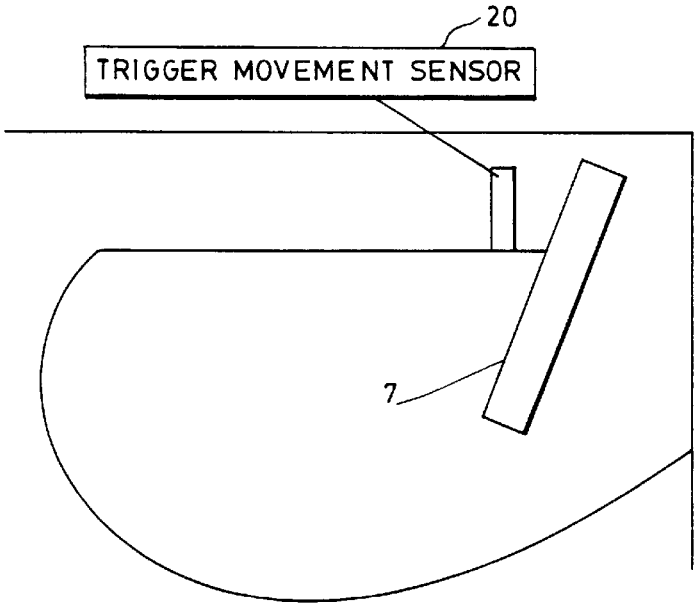
FIG. 4 is a schematic representation of the movement detection means associated with a trigger of a firearm.
Figure 6:
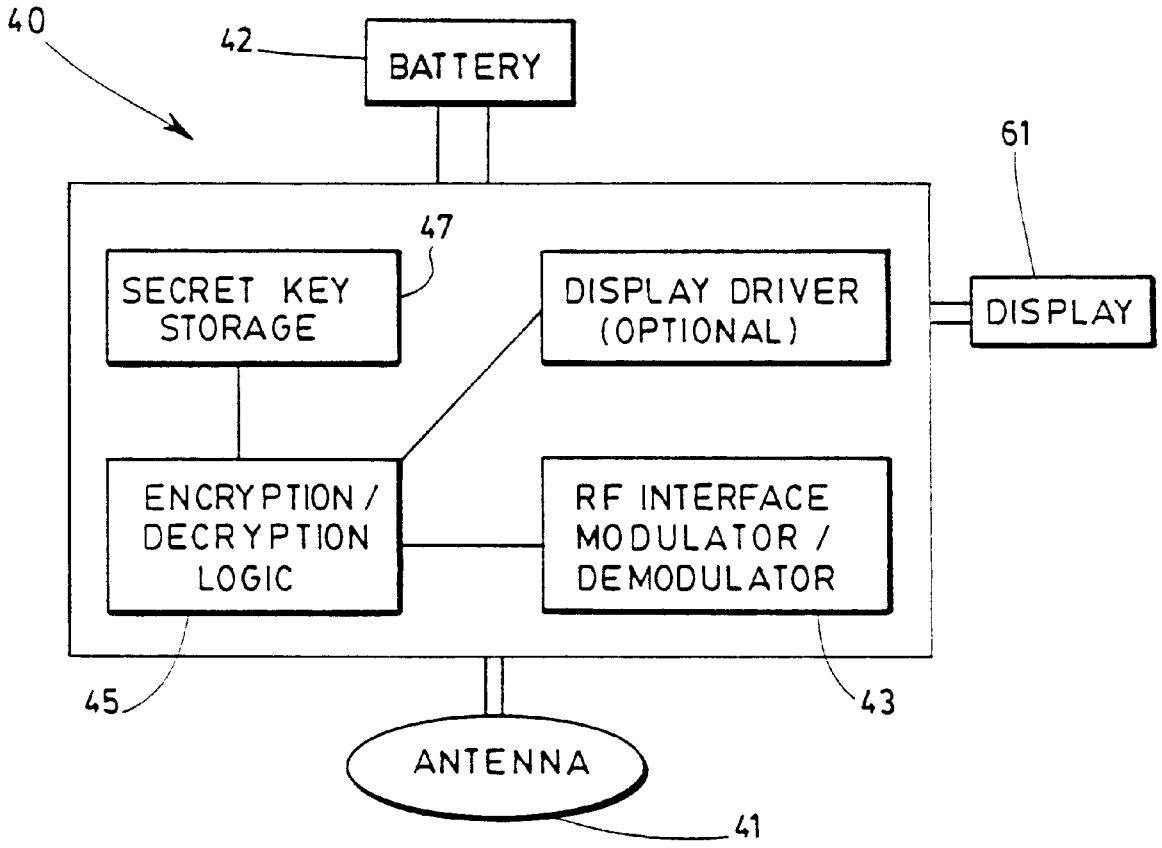
FIG. 6 is a schematic representation of the components of the token.

The system further includes at least one token 40 for receiving the coded signal and for transmitting a coded acknowledgement signal upon receipt of the coded signal. The at least one token 40 is separate from the firearm 1, but nonetheless located in close proximity thereof The token 40, as better shown in FIGS. 2, 3 and 6, includes an antenna 41, a receiver 43 coupled to the antenna 41 for receiving the coded signal generated by the transceiver means 30, an encoding/decoding module 45 for creating a coded acknowledgement signal and a transmitter 43 coupled to the antenna 41 for transmitting the coded acknowledgement signal. In a preferred embodiment shown in FIG. 6, the receiver 43 and the transmitter 43 are incorporated into a single interface. The token 40 also includes power means, such as a battery 42, for powering the token 40.

Preferably, the system only works if the token 40 is located in close proximity to the firearm 1. Accordingly, both the transceiver 30 and the token 40 can be programmed to respond to the coded signal and to the coded acknowledgement signal when the signal strength is above a predetermined threshold, indicating proximity. Typically, this proximity is no greater than one meter.

The system also includes means 50 for locking and unlocking the trigger operatively associated with the transceiver means 30 for allowing operation of the trigger and thereby the firing of the firearm when the coded acknowledgement signal has been received. The means 50 for locking and unlocking include an enable/disable switch, so that the trigger can be normally disabled (for example in the case of a firearm which is in a house, so that unauthorized users cannot fire the firearm) or normally enabled (for example for a police officer). It should be noted that the means 50 for locking can take the form of a trigger lock, a pin lock or a hammer lock.

The invention lies predominantly in bi-directional communication between the transceiver 30 and the token 40. This bi-directional communication considerably reduces the power consumption required, since the system will be used only when the trigger 7 has been moved, i.e. only when a person wishes to fire the firearm 1.

Accordingly, the communication protocol between the transceiver 30 and the token 40 is of primordial importance, and is done through RF. When the trigger 7 is moved sufficiently to trigger the movement detector 20, the transceiver 30 transmits a coded RF signal. Preferably, this coded signal is encrypted, using known encryption techniques and a secret key 37. The token 40 receives the coded signal and decrypts it using a secret key 37, again using known decryption techniques. If the received request is valid, i.e. if it uses a secret key known to the token 40, then the token 40 transmits an encrypted acknowledgement back to the transceiver 30. Upon receipt and decoding, i.e. decrypting of the acknowledgement signal, the transceiver 30 unlocks the locking means 50. It should be understood that the <<unlocking>> step depends on the state of the locking means 50, i.e. enabled or disabled. If the locking means 50 are disabled, then the receipt of the valid acknowledgement signal will enable it, meaning that the trigger 7 will be permitted to fire the firearm. However, if the locking means 50 are enabled, they will remain enabled upon receipt of a valid acknowledgement signal and will be disabled if there is no acknowledgement, or if it is invalid.

The bi-directional nature of the communication also increases the safety of the firearm 1, since an acknowledgement signal is requested each time the trigger 7 is depressed. As well, depending on the nature of the use of the firearm 1, such as for home security when the firearm 1 is normally disabled, the firearm 1 can be enabled, but only for a short period of time.

Other features may be incorporated in the system according to the present invention by transmitting additional information from the transceiver 30 to the token 40, such as status of the firearm 1 after each firing cycle, the number of shots fired, battery status etc. Of course, if such information is transmitted, the token 40 is preferably equipped to either store the information for future downloading, or to display such information on and LCD display 61, or both.

As mentioned previously, an authorized user may carry more than one token 40. In such a case, the communication protocol must include anti-collision detection and resolution in the communication protocol, in order to differentiate between the various tokens 40, and accept a coded acknowledgement signal only from one of them. This is the case, for example, where a police officer is a two-handed shooter and carries a token about each wrist. The anti-collision module will also be necessary where many officers are present at a location, each carrying at least one token. If the distances between each are relatively close, the transceiver 30 in the firearm 1 will be receiving acknowledgement signals from all tokens and must be able to discern between them.

The technique that is proposed to prevent such a problem is a transmit and standoff technique. When a coded signal has been sent by the transceiver 30, all the tokens 40 transmit, for example, a pseudo-random sequence of pulses and dead time to see if another token is actually transmitting. The sequence could include 10 to 12 symbols of a random number generated by the token 40. The transceiver 30, through a variety of known techniques such as peak detection, synchronous detection, carrier detection or a combination thereof, determines if there are one or more tokens 40 present, and selects from which token 40 the coded acknowledgement signal must be received. This technique is well known in the art.

Furthermore, the system must also be jamming-resistant, in order to ensure communication between the token and the transceiver regardless of the electromagnetic environment the authorized user is in. The technique that is proposed to resist jamming is to spread the transmitted signals over a wide range, so that the communication between the token 40 and the transceiver will be less susceptible to jamming. Again, this technique is well known in the art.

Preferably, the transceiver also includes a self-test to determine if a communication fault is due to an internal problem or to the absence of a token within a predetermined distance Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. An automatic firearm safety system comprising:

movement detection means operatively associated with a trigger of a firearm for detecting movement of said trigger, said movement detection means being integral to said firearm;

a unit including a transceiver means operatively associated with said movement detection means for sending a coded signal when movement of said trigger has been detected, said unit means being integral to said firearm and including power means;

at least one remote token for receiving said coded signal and for transmitting a coded acknowledgement signal upon receipt of said coded signal and further including power means;

means for locking and unlocking said trigger operatively associated with said transceiver means for allowing operation of said trigger and thereby the firing of said firearm when said coded acknowledgement signal has been received.

2. A system according to claim 1, wherein:

said unit includes:

an antenna;

a receiver coupled to said antenna for receiving said coded acknowledgement signal;

an encoding/decoding module for creating said coded signal; and a transmitter coupled to said antenna for transmitting said coded signal.

3. A system according to claim 2, wherein:

said at least one remote token comprises:

an antenna;

a receiver coupled to said antenna for receiving said coded signal;

an encoding/decoding module for creating said coded acknowledgement signal; and a transmitter coupled to said antenna for transmitting said coded acknowledgement signal.

4. A system according to claim 3, wherein:

said system comprises more than one token, and said transceiver further comprises an anti-collision technique for discriminating between said more than one token and selecting which one of said more than one token is permitted to issue said coded acknowledgement signal.

5. A system according to claim 4, wherein said coded signal further includes status information.

6. A system according to claim 4, wherein said transceiver further includes an anti-jamming module.

* * * * *